United States Patent [19]

Topping

[11] Patent Number: 4,592,332

[45] Date of Patent: Jun. 3, 1986

[54] ARROW REST DEVICE

[76] Inventor: Donald G. Topping, 886 Woodbine Dr., Crestwood, Mo. 63126

[21] Appl. No.: 602,692

[22] Filed: Apr. 23, 1984

[51] Int. Cl.[4] ..... F41B 5/00

[52] U.S. Cl. ..... 124/41 A; 124/24 R

[58] Field of Search ..... 124/24 R, 41 A

[56] References Cited

U.S. PATENT DOCUMENTS

| | | | |
|---|---|---|---|
| 3,482,563 | 12/1969 | Pint | 124/24 R |
| 4,119,078 | 10/1978 | Wilson et al. | 124/41 A |
| 4,170,980 | 10/1979 | Killian | 124/41 A |
| 4,215,666 | 8/1980 | Carroll et al. | 124/41 A |
| 4,332,232 | 6/1982 | Troncoso, Jr. | 124/41 A |

*Primary Examiner*—Richard C. Pinkham
*Assistant Examiner*—Benjamin Layno
*Attorney, Agent, or Firm*—Charles E. Markham

[57] ABSTRACT

An arrow rest including, a support plate detachably connected to one end of a non-circular rod slidable longitudinally in a non-circular bore in a body member mounted in a bow handle, a coil spring biasing the rod and arrow rest outward from one side of the bow handle, a first threadedly adjustable screw member in the body having a one way connection with the rod variably limiting the outward movement of the arrow rest under the spring bias and a second screw member threadedly adjustable in said first adjustable screw member having an operative connection with one end of the coil spring for varying the bias on the rod and arrow rest whereby either the position of the arrow rest or the spring biasing force acting thereon may be adjusted without affecting the adjustment of the other.

2 Claims, 15 Drawing Figures

ARROW REST DEVICE

This invention relates generally to archery bows and particularly concerns a spring pressed arrow rest which is positionably adjustable with respect to the adjacent side of a bow handle and adjustable to flex inward toward the adjacent side under a finite impact.

BACKGROUND OF THE INVENTION

Adjustable arrow rests for in and out adjustment with respect to the adjacent side of a bow handle on which they are mounted have been in use for many years. Also spring pressed arrow spacer buttons which are positionably adjustable as well as adjustably yieldable have been in use for a long time. However, when a spring pressed, positionably adjustable arrow spacer button is employed with a fixed position arrow rest the arrow is required to move laterally along the underlying arrow support element when the spacer button is positionally adjusted. Inasmuch as many of the underlying arrow support elements are designed and configured so as to substantially confine or at least limit lateral movement of the fore end of an arrow in many instances the positional adjustment of the spacer button would be indeed limited. There are obvious advantages in confining the arrow to a finite lateral position on its underlying support element.

Applicant has provided an arrow rest device for mounting on a bow handle which is both adjustably yieldable to lateral arrow pressure acting inward toward the adjacent side of the bow handle and positionably adjustable in or out with respect to the adjacent side of the bow handle.

OBJECTS OF THE INVENTION

A primary object of this invention is to provide a generally new and improved arrow rest device which is both positionably adjustable and yieldably adjustable.

A further object is to provide an arrow rest device which is both positionably adjustable and adjustably spring pressed in one direction so as to variably yield in an opposite direction and in which the adjustment of position of the arrow rest does not effect the adjustment of the spring pressure.

These and further objects and advantages will become apparent when reading the following description in connection with the accompanying drawings.

IN THE DRAWINGS

DESCRIPTION OF A PREFERRED FORM OF THE INVENTION

Figures 1, 2, 3, 4, 5, 6, 7, 8, 9, 10, 11, 12, 13, 14, 15:
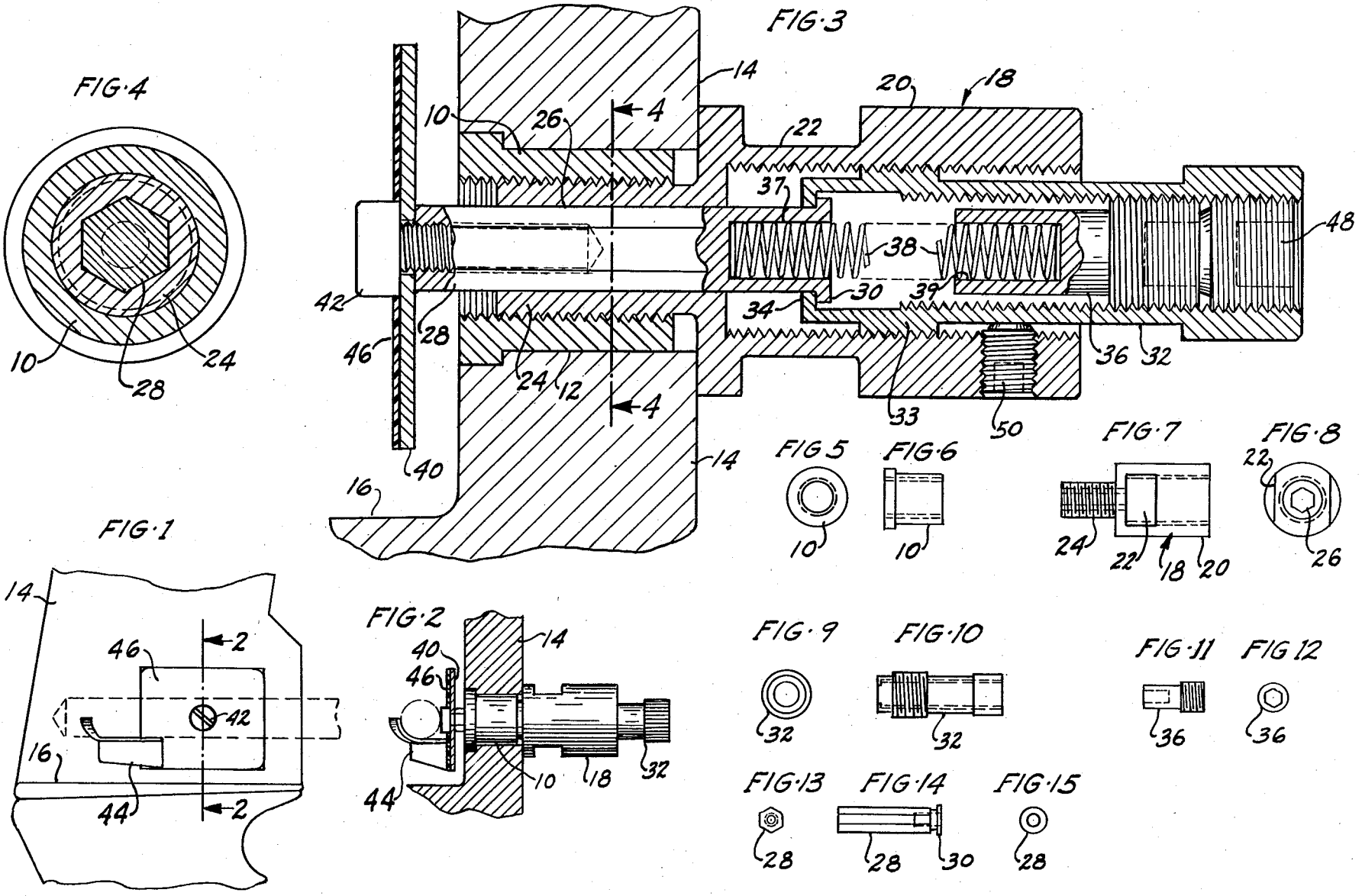
FIG. 1 is a fragmentary side elevational view of a bow handle section with an arrow rest device mounted thereon and constructed in accordance with the present invention.
FIG. 2 is a longitudinal cross sectional view taken on line 2—2 of FIG. 1.
FIG. 3 is a greatly enlarged longitudinal cross sectional view taken on line 2—2 of FIG. 1.
FIG. 4 is a transverse cross sectional view taken along line 4—4 of FIG. 3.
FIGS. 5 and 6 are end and side elevational views of the hollow internally screw threaded and flanged mounting bushings.
FIGS. 7 and 8 are side elevation and end views of the hollow cylindrical body member.
FIGS. 9 and 10 are end and side elevational views of the arrow rest positional adjustment member.
FIGS. 11 and 12 are side elevational and end views of the spring adjustment member.
FIGS. 13, 14 and 15 are end and side elevational views of the hexagonal (non-circular) rod.

Referring to the drawings in more detail, an internally screw threaded, hollow cylindrical bushing 10, flanged at one end is fitted into a bore 12 extending horizontally from side to side through a bow handle 14 just above the usual ledge 16. A cylindrical body member generally indicated at 18 has a larger diameter hollow cylindrical portion 20 at one end which is internally screw threaded and is provided with external wrench flats 22. Body member 18 also has a smaller outside diameter opposite end portion 24 which is externally screw threaded and is threadedly engaged in the bushing 12 whereby it is fixed to the bow handle. The smaller diameter portion 24 is also provided with a longitudinal axial bore 26 extending therethrough which bore is hexagonal in cross section.

Slidable longitudinally in bore 26 is a rod 28, hexagonal in cross section. One end portion of hexagonal rod 26 extends into the larger diameter portion 20 of hollow cylindrical body member 18 and is provided at this end with a circular flange 30 which is slightly larger in diameter than the dimension across the corners of the hexagonal portion. An elongated, hollow cylindrical positional adjustment member 32 has an externally screw threaded portion 33 and is entered in screw threaded engagement into the larger diameter end porton 20 of member 18. The circular flanged end 30 of hexagonal rod 28 also extends into the inner end of hollow cylindrical adjustment member 32. A cooperating annular ledge 34 formed at the inner end of member 32 provides a one way connection with the circular flanged end of rod 28. Rod 28 is therefore permitted to move longitudinally inward relative to member 32 but is prevented from moving outward relative thereto.

The hollow cylindrical positional adjustment member 32 is also internally screw threaded and an externally screw threaded cylindrical spring adjustment member 36 is inserted in screw threaded engagement member 32. The inner end portions of hexagon rod 28 and spring adjustment member 36 are blind bored axially at 37 and 39 and receive opposite ends of a helical spring 38. The spring 38 therefore constantly biases the circular flanged end 30 of rod 28 in contact with the annular ledge 34. At its outer exterior end the hexagonal rod 28 has detachably connected thereto an arrow rest support plate 40. The support plate 40 is detachably connected to the end of rod 28 by a headed screw 42 entering a screw threaded axial bore extending longitudinally inward from the outer end of the rod. The head of screw 42 provides a spacer for spacing an arrow a finite distance from the surface of plate 40.

The underlying arrow support element 44 shown in FIGS. 1 and 2 is formed integral with a flat attaching portion 46 and constructed of a pliable synthetic plastic material, the attaching portion 46 being attached to the surface of support plate 40 by an adhesive material. The spring adjustment member 36 is provided with a hexagon shaped cavity in its outer end to accomodate an Allen wrench and the outer end of positional adjustment member 32 is knurled. Member 36 is locked in an adjusted position in member 32 by Allen set screw 48. An Allen set screw 50 is also provided and entered into a transverse screw threaded bore in the body member 18 to lock an adjusted position of member 32.

It will be understood that the bushing 10 may be eliminated and the externally screw threaded small diameter portion 24 of body 18 screw threaded directly into a screw threaded bore of suitable size extending from side to side through the bow handle. It will also be understood that the diameter of the circular flange 30 on the inner end of hexagonal rod 28 is sufficiently smaller than the minor diameter of the internal screw threads of hollow positional adjustment member 32 to permit its passage therethrough.

ASSEMBLY

The bushing 10 is placed in the bore 12 in the bow handle and then the smaller diameter, externally screw threaded portion 24 of body member 18 is entered in threaded engagement into bushing 10 and tightened thereby fixedly attaching the body 18 to the bow handle. The positional adjustment member 32 is then threadedly engaged in the internally screw threaded, larger diameter portion of body 18. Next the hexagonal rod 28 is inserted through the aperture at the inner end of member 32 defined by the annular ledge 34 and then entered into the hexagonal bore 26 in the smaller diameter end portion 24. One end of spring 38 is next inserted into bore 37 in the inner end of hexagon rod 28 and spring adjustment member 36 is then entered in threaded engagement into the positional adjustment member 32 and causing the other end of spring 38 to be inserted into blind bore 39 in the inner end of member 36. The support plate 40 is then detachably connected to the exterior end of hexagon rod 28 by the headed screw 42.

Inasmuch as the angular position of the flat sides of the hexagonal bore 26 with respect to the vertical or horizontal is unpredictable when the body member 18 is tightened in bushing 10 the support plate 40 and attached underlying arrow support element must be attached by some means as shown which will permit suitable alignment of the support plate with the horizontal.

I claim:

1. In an archery bow an arrow rest device comprising an elongated cylindrical body having a first smaller diameter portion fixed in and extending from side to side through the handle section of the bow and a second larger diameter portion projecting from one side thereof, said second portion having a relatively large diameter screw threaded axial bore therethrough and said first portion having a smaller non-circular axial bore therethrough, a hollow cylindrical internally and externally screw threaded positional adjustment member threadedly engaged in said larger second portion, said positional adjustment member having a transverse inner end wall with a central perforation therein, a one piece, non circular rod having a circular flange at one end larger than said central perforation passes through said perforation with said end flange abutting said end wall, and with said rod extending through and slidable in said non-circular axial bore in said first body portion, a screw threaded spring adjustment member threadedly engaged in the outer end of said positional adjustment member, a spring biased betwen the inner end of said rod and the inner end of said spring adjustment member for yieldably holding said end flange against said end wall, and an arrow rest support plate having an arrow rest element attached thereto detachably connected to the other end of said rod.

2. The arrow rest device for an archery bow claimed in claim 1 further comprising an axial screw threaded bore in the end of said rod and a headed screw adapted to be threadably engaged to said axial screw threaded bore for detachably connecting the arrow rest support plate to the end of said rod in which the screw head serves as an arrow contacting element for spacing an arrow from the surface of said support plate.

* * * * *